United States Patent [19]

Gerke, Jr. et al.

[11] Patent Number: 4,920,606

[45] Date of Patent: May 1, 1990

[54] ELECTRICAL POWER CIRCUIT FOR A VACUUM CLEANER

[75] Inventors; Burton E. Gerke, Jr., Newtown; Michael E. Bitzel, Monroe; Robert Kubicko, Huntington; Charles Z. Krasznai, Trumbull, all of Conn.

[73] Assignee: Black & Decker, Inc., Newark, Del.

[21] Appl. No.: 294,617

[22] Filed: Jan. 9, 1989

[51] Int. Cl.[5] ..... A47L 5/26

[52] U.S. Cl. ..... 15/338; 15/344; 15/377; 15/412

[58] Field of Search ..... 15/338, 339, 344, 412, 15/377

[56] References Cited

U.S. PATENT DOCUMENTS

| | | | |
|---|---|---|---|
| 3,018,504 | 1/1962 | Hart | 15/320 |
| 3,267,510 | 8/1966 | Cote | 15/344 |
| 3,579,706 | 5/1971 | Hetland | 15/377 |
| 4,209,875 | 7/1980 | Pugh et al. | 15/344 |
| 4,306,558 | 12/1981 | Kurtz et al. | 15/327 R X |
| 4,513,470 | 4/1985 | Toya | 15/328 |
| 4,542,557 | 9/1985 | Levine | 15/344 |
| 4,573,234 | 3/1986 | Kochte et al. | 15/323 |
| 4,577,365 | 3/1986 | Yuen | 15/339 |
| 4,610,048 | 9/1986 | Ishihara et al. | 15/344 |
| 4,642,841 | 2/1987 | Berfield et al. | 15/330 |
| 4,665,582 | 5/1987 | Richmond et al. | 15/344 |
| 4,682,384 | 7/1987 | Prahl et al. | 15/344 |
| 4,841,594 | 6/1989 | Elson et al. | 15/338 |

FOREIGN PATENT DOCUMENTS

| | | |
|---|---|---|
| 1144716 | 4/1983 | Canada . |
| 2178949 | 2/1987 | United Kingdom . |

*Primary Examiner*—Chris K. Moore

*Attorney, Agent, or Firm*—Barry E. Deutsch

[57] ABSTRACT

The present invention is a vacuum cleaner and accessory attachment assembly including a vacuum cleaner and an accessory attachment. The vacuum cleaner includes a motor, a housing enclosing the motor and a fan driven by the motor for producing a vacuum. The vacuum cleaner also includes a canister removably attached to the housing for reception of air and foreign matter into the canister in response to the vacuum produced by the fan. The vacuum cleaner further includes a power source and electrical wiring interconnecting the power source and the motor. The accessory attachment is removably mounted to the vacuum cleaner and includes a motor, and means for electrically connecting the motor to the vacuum cleaner. The vacuum cleaner includes means for allowing the speed of the motor of the vacuum cleaner to change while allowing the speed of the motor for the accessory attachment to remain constant.

12 Claims, 5 Drawing Sheets

ELECTRICAL POWER CIRCUIT FOR A VACUUM CLEANER

BACKGROUND OF THE INVENTION

1. Field of the Invention

The present invention relates generally to portable vacuum cleaners, more particularly to, a vacuum cleaner capable of operating with both air and liquid.

2. Description of Related Art

Currently, there exist portable vacuum cleaners which pick up or vacuum solid or liquid material. These portable vacuum cleaners are frequently referred to as "wet-dry" vacuum cleaners. Commonly, such vacuum cleaners include an electric motor for imparting rotation to a blower to create a partial vacuum. The motor is typically connected by electrical wiring to a plurality of batteries acting as the power source to power the motor. The vacuum cleaner also includes a switch which provides for the coupling of electric power from the batteries to the motor. Optionally, an accessory having a motor to drive a brush or the like may be coupled to the vacuum cleaner.

One disadvantage of the above vacuum cleaner is that if an accessory is attached, when the speed of the motor for the vacuum cleaner is increased or decreased, the speed of the motor for the accessory increased or decreased.

It is, therefore, an object of the present invention to provide an electrical power circuit for a vacuum cleaner in which the speed of the motor for the vacuum cleaner may be increased or decreased for changing the fan suction without affecting or changing the speed of the accessory motor.

SUMMARY OF THE INVENTION

Accordingly, the present invention is a vacuum cleaner and accessory attachment assembly including a vacuum cleaner and an accessory attachment. The vacuum cleaner includes a motor, a housing enclosing the motor and a fan driven by the motor for producing a vacuum. The vacuum cleaner also includes a canister removably attached to the housing for reception of air and foreign matter into the canister in response to the vacuum produced by the fan. The vacuum cleaner further includes a power source and electrical wiring interconnecting the power source and the motor. The accessory attachment is removably mounted to the vacuum cleaner and includes a motor, and means for electrically connecting the motor to the vacuum cleaner. The vacuum cleaner includes means for allowing the speed of the motor of the vacuum cleaner to change while allowing the relative speed of the motor for the accessory attachment to remain constant.

One advantage of the present invention is that the electrical circuit provides power for changing the rate of fan suction by allowing the speed of the motor for the vacuum cleaner to be increased or decreased. Another advantage of the present invention is that the speed of the accessory motor remains constant or is not increased or decreased when the speed of the motor for the vacuum cleaner is increased or decreased.

Other advantages of the present invention will be readily appreciated as the same becomes better understood by reference to the following detailed description when considered in connection with the accompanying drawings.

DESCRIPTION OF THE PREFERRED EMBODIMENT

Figure 1:
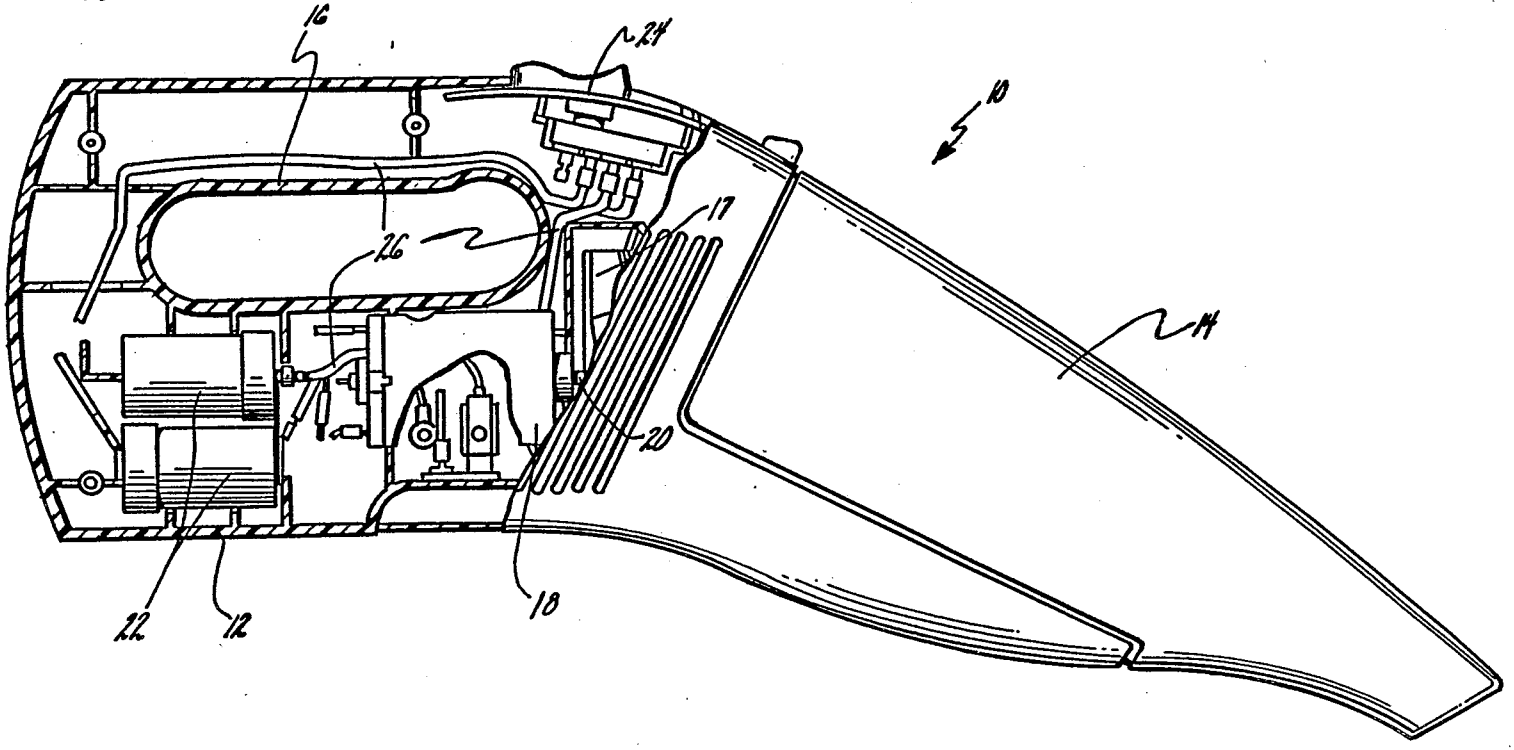
FIG. 1 is an elevational view with a portion broken away of a vacuum cleaner incorporating the present invention.

Referring to FIG. 1, a vacuum cleaner 10 incorporating the present invention is shown. The vacuum cleaner 10 includes a central housing 12 having a canister 14 affixed to a front end thereof and a handle 16 formed near the back end thereof. The handle 16 is configured to be grasped by the hand of a person using the vacuum cleaner 10 for the cleaning of upholstery, rugs, as well as in the dusting of flat surfaces such as the top of a table.

The housing 12 contains a source of suction or fan 17 which may also be referred to as a blower or impeller, and an electric motor 18 coupled by a shaft 20 to the blower 17. Rotation of the shaft 20 by the motor 18 imparts rotation to the blower 17 to create a partial vacuum and the accompanying suction which draws air and foreign matter into the canister 14. The motor 18 is powered by a plurality of batteries 22. A multi-position switch 24 is positioned on the upperside of the handle 16 for convenient engagement by means of the thumb of a person utilizing the vacuum cleaner 10. Operation of the switch 24 provides for the coupling of electric power from the batteries 22 to the motor 18 for activation of the motor 18. Electric wiring 26 connects the batteries 22 by the switch 24 to the motor 18.

Figure 3:
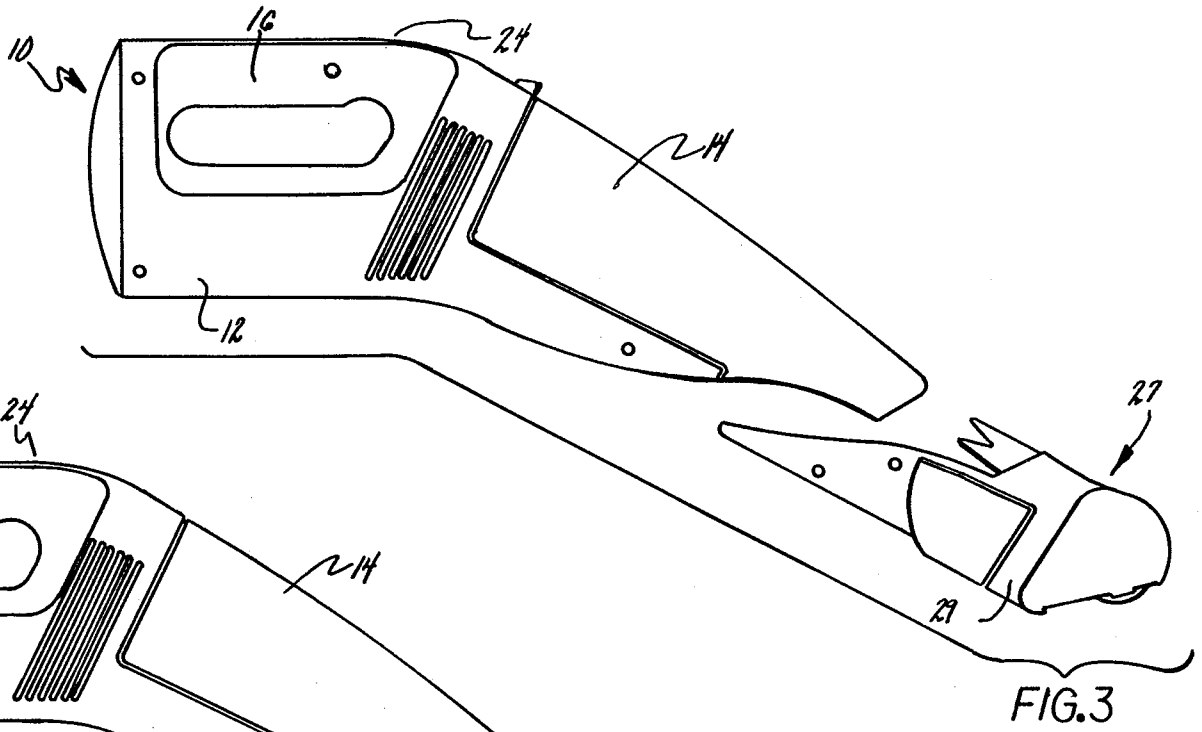
FIG. 3 is an exploded elevational view of the vacuum cleaner and accessory brush attachment of FIG. 2.
Figure 2:
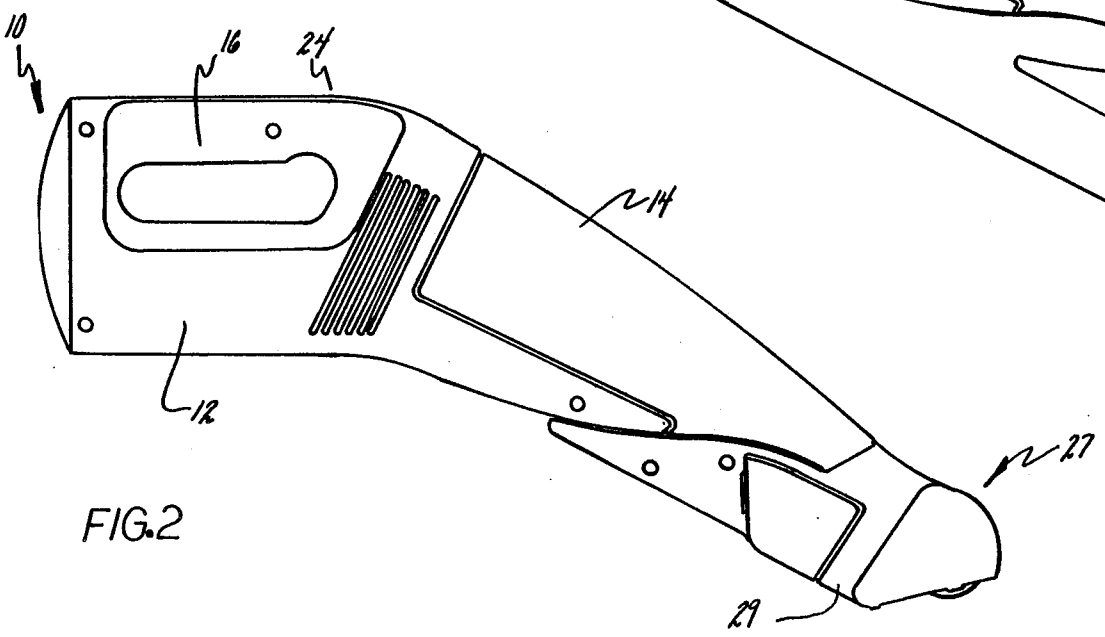
FIG. 2 is an elevational view of the vacuum cleaner of FIG. 1 and an accessory brush attachment in an assembled condition.
Figure 4:
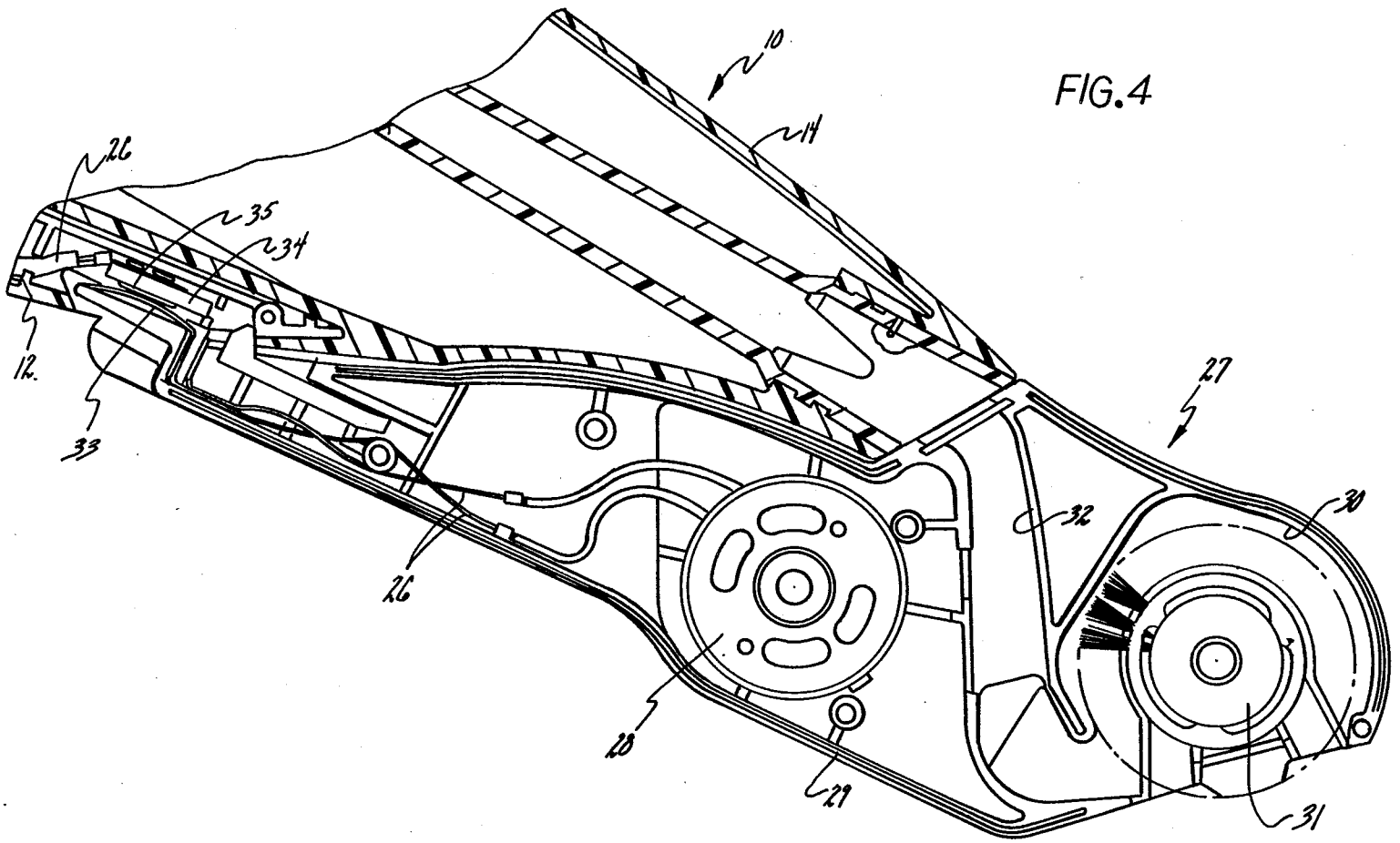
FIG. 4 is a partial sectional view of the vacuum cleaner and accessory brush attachment of FIG. 2.

Referring to FIGS. 2 through 4, the accessory or power brush attachment 27 for use with the vacuum cleaner 10 is shown. The accessory brush attachment 27 includes an accessory motor 28 and an accessory housing 29 enclosing the accessory motor 28 as illustrated in FIG. 4. The forward end of the accessory housing 29 includes a brush cavity 30 formed therein. A brush 31 is rotatably mounted within the brush cavity 30 and is rotated by the accessory motor 28.

The accessory brush attachment 27 also includes a passageway 32 formed within the accessory housing 29 which fluidly communicates with the brush cavity 30 and the canister 14. Air flow caused by the vacuum produced by the fan 17 of the vacuum cleaner 10 travels from the brush cavity 30, through the passageway 32, and into the canister 14 of the vacuum cleaner 10.

The accessory brush attachment 27 includes a pair of laterally spaced contact strips 33 at one end thereof. The contact strips 33 are metallic and flexible. The contact strips 33 are connected by electrical wiring 26 to the accessory motor 28. The vacuum cleaner 10 also includes a terminal block 34 secured to the vacuum housing 12. As illustrated in FIG. 4, the terminal block 34 includes a pair of contacts 35 which are connected by electrical wiring 26 to the switch 24 and batteries 22 to allow electrical power to flow to the accessory motor 28 upon actuating the switch 24.

Figure 5:
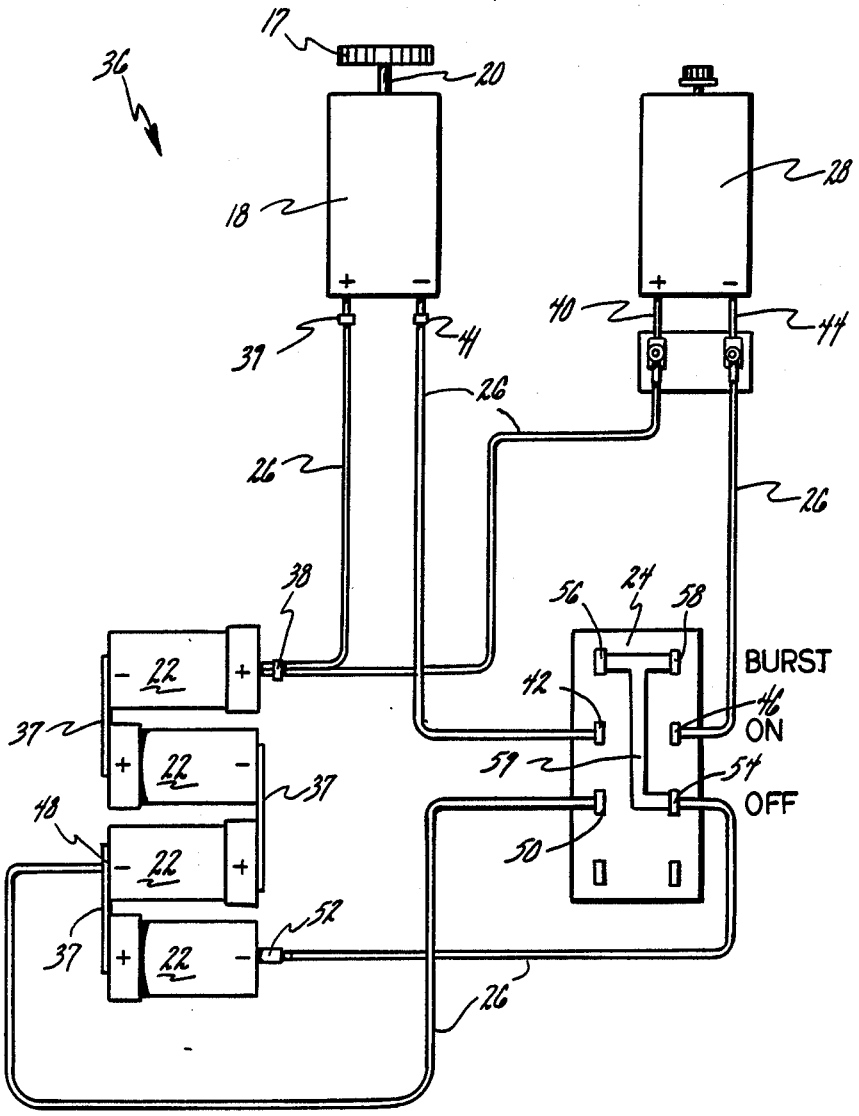
FIG. 5 is an electrical circuit schematic of the vacuum cleaner and accessory brush attachment of FIG. 2.

Referring to FIG. 5, a schematic diagram of an electrical circuit 36 is shown. In the electrical circuit 36, preferably four (4) batteries 22 are used. The batteries 22 are serially connected by metallic strips 37 to each other. A positive end 38 of the first battery 22 is connected to a positive terminal 39 of the fan motor 18 and a positive terminal 40 of an accessory motor 28. A negative terminal 41 of the fan motor 18 is connected to a second pin 42 of the switch 24. A negative terminal 44 of the accessory motor 28 is connected to a seventh pin 46 of the switch 24. A negative end 48 of the third battery 22 is connected to a third pin 50 of the switch 24. A negative end 52 of a fourth battery 22 is connected to a sixth pin 54 of the switch 24. A metallic strip 59 interconnects pins 56, 58 and 54. It should be appreciated that the switch 24 has a pair of longitudinally spaced feet (not shown) for bridging a pair of opposed pin connections.

The switch 24 has an "OFF" or non-operable position which prevents the flow of electrical power from the batteries 22 to the motors 18 and 28. The switch 24 also has an "ON" or first operable position for allowing the flow of electrical power from the batteries 22 to the motors 18 and 28. The switch 24 further has a "BURST" or second operable position to increase or decrease the flow of electrical power from the batteries 22 to the fan motor 18 without changing the relative electrical power flow to the accessory motor 28. The positions of the switch 24 and the bridge connections between the pins are tabulated as follows:

In operation, when the switch 24 is in the "ON" position and the accessory motor 28 is not attached or part of the electrical circuit 36, three of the batteries 22 of the electrical circuit 36 are used to supply sufficient electrical power to operate the fan motor 18. Electrical power flows from the positive end 38 of the first battery 22 and across the terminals 39 and 41 of the fan motor 18 and pins 42, 50 and 54 to the negative terminal 48 of the third battery 22.

When the accessory motor 28 is attached or part of the electrical circuit 36 and the switch 24 is in the ON position, all four batteries 22 are used to supply sufficient electrical power to operate the fan motor 18 and accessory motor 28. Electrical power flows from the positive end 38 of the first battery 22 across the terminals 39 and 41 of the fan motor 18 and terminals 40 and 44 of the accessory motor 28 to the switch 24. The switch 24 makes a bridge connection between pins 42, 46, 50 and 54 to allow electrical power to flow to the negative terminal 52 of the fourth battery 22 to complete the circuit.

When additional suction is desired and the accessory motor 28 is not attached to the circuit 36, the switch 24 is moved to the "BURST" position to electrically connect all four batteries 22 to the motor 18 by the switch 24 making bridge connections between pins 42, 56, 58 and 54 to increase the speed of the fan motor 18. Also, when the accessory motor 28 is attached to the electrical circuit 36, the switch 24 is moved to the "BURST" position making bridge connections between pins 42, 46, 56, 58 and 54 to electrically connect all four batteries 22 to change the speed of the blower or fan motor 18 without changing the relative speed to the accessory motor 28 which requires electrical power from all four batteries to operate.

Figure 6:
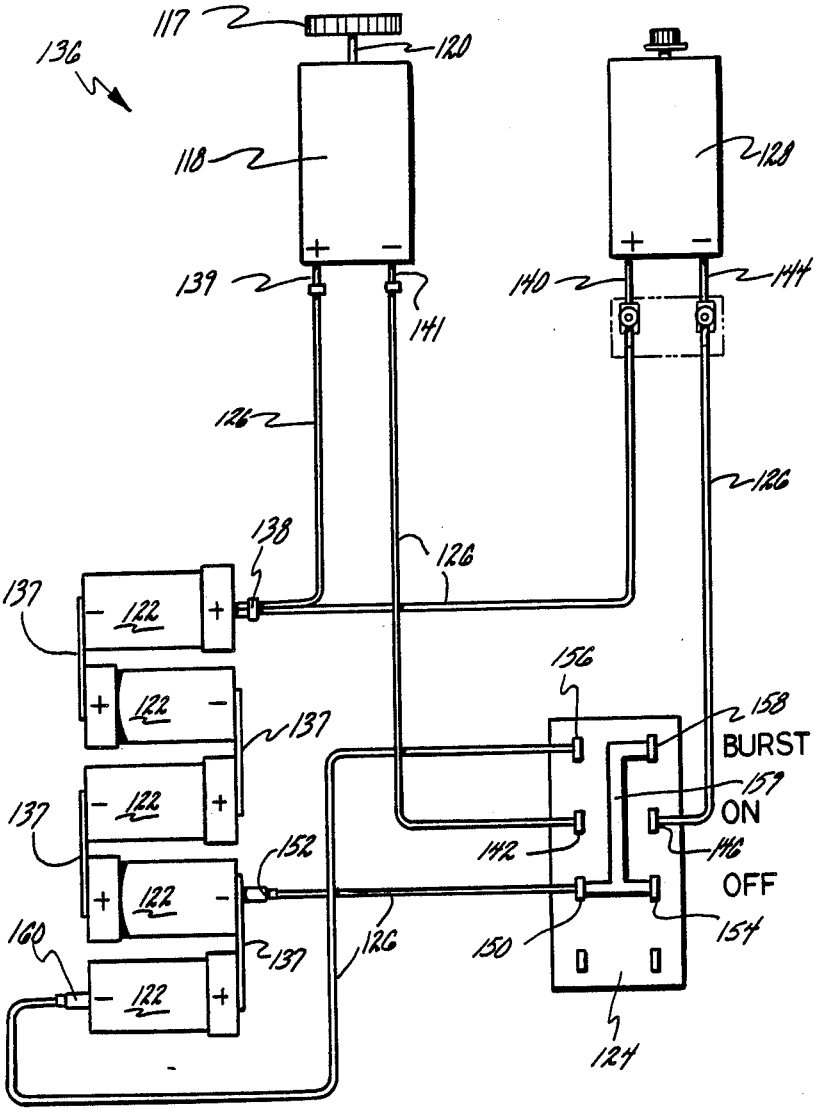
FIG. 6 is an alternate electrical circuit schematic of the vacuum cleaner and accessory brush attachment.

Referring to FIG. 6, an alternate embodiment of the electrical circuit 36 is shown at 136. Like parts have like numerals increased by one hundred (100). In the circuit 136, preferably five (5)- batteries 122 are used. The negative terminal 152 of the fourth battery 122 is connected by electrical wiring 126 to the third pin 150 of the switch 124. The metallic strip 159 interconnects pins 150, 154 and 158. A negative terminal 160 of the fifth battery 122 is connected by electrical wiring 126 to the first pin 156 of the switch 124. The positions of the switch 124 and the bridge connections between the pins are tabulated as follows:

In operation, when the switch 124 is in the "ON" position and the accessory motor 128 is not attached or part of the electrical circuit 136, four of the batteries 122 of the electrical circuit 136 are used to supply sufficient electrical power to operate the fan motor 118. Electrical power flows from the positive end 138 of the first battery 122 and across the terminals 139 and 141 of the fan motor 118 and pins 142, 150 and 154 to the negative terminal 152 of the fourth battery 122.

When the accessory motor 128 is attached or part of the electrical circuit 136 and the switch 124 is in the ON position, all four batteries 122 are used to supply sufficient electrical power to operate the fan motor 118 and accessory motor 128. Electrical power flows from the positive end 138 of the first battery 122 across the terminals 139 and 141 of the fan motor 118 and terminals 140 and 144 of the accessory motor 128 to the switch 124. The switch 124 makes a bridge connection between pins 142, 146 and 150 to allow electrical power to flow to the negative terminal 152 of the fourth battery 122 to complete the circuit.

When additional suction is desired and the accessory motor 128 is not attached to the circuit 136, the switch 124 is moved to the "BURST" position to electrically connect all five batteries 122 to the fan motor 118 by the switch 124 making bridge connections between pins 142, 156, 158 and 150 to increase the speed of the fan motor 118. Also, when the accessory motor 128 is attached to the electrical circuit 136, the switch 124 is moved to the "BURST" position making bridge connections between pins 142, 146, 150, 156, and 158 to electrically connect all five batteries 122 to increase or decrease the speed of the blower or fan motor 118 without changing the relative speed to the accessory motor 128 which requires electrical power from four batteries 122 to operate.

The present invention has been described in an illustrative manner. It is to be understood that the terminology which has been used is intended to be in the nature of words of description rather than of limitation.

Obviously, many modifications or variations of the present invention are possible in light of the above teachings. Therefore, within the scope of the appended claims, the present invention may be practiced otherwise than as specifically described.

What is claimed is:

1. A vacuum cleaner and accessory attachment assembly comprising:

a vacuum cleaner including a motor, a housing enclosing said motor, a fan driven by said motor for producing a vacuum, a canister removably attached to said housing for reception of air and foreign matter into said canister in response to the vacuum produced by said fan, a plurality of batteries electrically connected together for supplying electrical power to said motor;

an accessory attachment removably mounted to said vacuum cleaner and including a motor, and means for electrically connecting said motor to said plurality of batteries of said vacuum cleaner; and said vacuum cleaner including electrical circuit means for connecting the motor of said accessory attachment to a constant number of said plurality of batteries while enabling the motor of said vacuum cleaner to be selectively connected to a first group of said plurality of batteries to operate the motor at a first speed and to a second group of said plurality of batteries to operate the motor at a second speed.

2. An assembly as set forth in claim 1 wherein said electrical circuit means comprises a switch electrically connected to said plurality of batteries and said motor of said vacuum cleaner and said motor of said accessory attachment, said switch having a first position discontinuing electrical power to said motor of said vacuum cleaner and said accessory attachment, a second position for allowing electrical power to flow from said plurality of batteries to said motor of said vacuum cleaner and said accessory attachment, and a third position for changing the flow of electrical power to said motor of said vacuum cleaner and for allowing the flow of electrical power to said motor of said accessory to remain constant.

3. An assembly as set forth in claim 2 wherein said plurality of batteries is used to power said motor of said vacuum cleaner and when said switch is in said second position to operate said motor at a first speed.

4. An assembly as set forth in claim 3 wherein said plurality of batteries is used to power said motor of said vacuum cleaner when said switch is in said third position to operate said motor at a second speed which is faster than said first motor speed.

5. An assembly as set forth in claim 4 wherein said plurality of batteries is used to power said motor of said vacuum cleaner and said accessory attachment when said switch is in said second position to operate each of said motors at the same relative speed wherein said switch comprises a plurality of spaced contacts, with selected ones of said contacts being continuously electrically connected by electrical wiring formed integrally with said switch.

6. An electrical circuit for a vacuum cleaner engageable with an accessory attachment, said circuit comprising:

a plurality of batteries connected electrically together;

a fan motor for the vacuum cleaner;

an accessory motor for the accessory attachment;

a switch;

means interconnecting said fan motor and said accessory motor and said plurality of batteries and said switch, said switch having a nonoperable position to prevent the flow of electrical power from said plurality of batteries to said fan motor and said accessory motor; and a first operable position to allow electrical power to flow from said plurality of batteries to said fan motor and accessory motor; and said switch including means for having a second operable position for changing the flow of electrical power from said plurality of batteries to said fan motor and for allowing the flow of electrical power from said plurality of batteries to said accessory motor to remain constant.

7. An electrical circuit as set forth in claim 6 wherein four of said batteries are used to power said motor of said vacuum cleaner and said accessory attachment when said switch is in said first operable position.

8. An electrical circuit as set forth in claim 7 wherein four of said batteries are used to power said fan motor of said vacuum cleaner when said switch is in said second operable position.

9. An electrical circuit as set forth in claim 8, wherein said power source comprises at least five batteries connected electrically together in series.

10. An electrical circuit as set forth in claim 9 wherein four of said batteries are used to power said motor of said vacuum cleaner and said accessory attachment when said switch is in said first operable position.

11. An electrical circuit as set forth in claim 10 wherein five of said batteries are used to power said motor of said vacuum cleaner and four of said batteries are used to power said motor of said accessory attachment when said switch is in said second operabale position.

12. A vacuum cleaner and accessory attachemnt assembly comprising:

a vacuum cleaner including a motor, a housing enclosing said motor, a fan driven by said motor for producing a vacuum, a canister removably attached to said housing for reception of air and foreign matter into said canister in response to the vacuum produced by said fan, a plurality of batteries for supplying power to said motor; an accessory attachment removably mounted to said vacuum cleaner and including a motor, and means for electrically connecting said motor to said plurality of batteries of said vacuum cleaner;

said vacuum cleaner including electrical circuit means for allowing the speed of said motor of said vacuum cleaner to change while allowing the speed of said motor of said accessory attachment to remain constant; and said means comprises a switch electrically connected to said plurality of batteries and said motor of said vacuum cleaner and said motor of said accessory attachment, said switch having a first position discontinuing electrical power to said motor of said vacuum cleaner and said accessory attachment, a second position for allowing electrical power to flow from said plurality of batteries to said motor of said vacuum cleaner and said accessory attachment, and a third position for increasing the flow of electrical power to said motor of said vacuum and for allowing the flow of electrical power to said motor of said accessory to remain constant.

* * * * *

UNITED STATES PATENT AND TRADEMARK OFFICE

CERTIFICATE OF CORRECTION

PATENT NO. : 4,920,606

DATED : May 1, 1990

INVENTOR(S) : Burton E. Gerke, Jr., Robert Kubicko, Charles Z. Krasznai and Michael Bitzel It is certified that error appears in the above-identified patent and that said Letters Patent is hereby corrected as shown below:

Column 3, after line 32 insert

| SWITCH POSITION | BRIDGE CONNECTIONS FOR PINS WITHOUT ACCESSORY MOTOR OF SWITCH | BRIDGE CONNECTIONS FOR PINS WITH ACCESSORY MOTOR OF SWITCH |
|---|---|---|
| OFF | 50, 54 | 50, 54 |
| ON | 42, 50, 54 | 42, 46, 50, 54 |
| BURST | 42, 54, 56, 58 | 42, 46, 54, 56, 58 |

Column 4, after line 13 insert

| SWITCH POSITION | BRIDGE CONNECTIONS FOR PINS WITHOUT ACCESSORY MOTOR ATTACHED | BRIDGE CONNECTIONS FOR PINS WITH ACCESSORY MOTOR ATTACHED |
|---|---|---|
| OFF | 150, 154 | 150, 154 |
| ON | 142, 150, 154 | 142, 146, 150, 154 |
| BURST | 142, 156, 158, 150 | 142, 146, 150, 156, 158 |

Signed and Sealed this

Twenty-second Day of September, 1992

*Attest:*

DOUGLAS B. COMER

*Attesting Officer*

*Acting Commissioner of Patents and Trademarks*